US007058344B2

(12) United States Patent
Mizutani et al.

(10) Patent No.: US 7,058,344 B2
(45) Date of Patent: Jun. 6, 2006

(54) DEVELOPING APPARATUS

(75) Inventors: Takao Mizutani, Tokyo (JP); Akihito Onishi, Tokyo (JP); Tetsuya Segawa, Fukushima (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/884,938

(22) Filed: Jul. 7, 2004

(65) Prior Publication Data

US 2005/0008402 A1 Jan. 13, 2005

(30) Foreign Application Priority Data

Jul. 9, 2003 (JP) ..... 2003-272193

(51) Int. Cl.
*G03G 15/08* (2006.01)

(52) U.S. Cl. ..... 399/281; 399/272

(58) Field of Classification Search ..... 399/281, 399/272, 273, 279, 283, 286; 492/53, 56, 492/59

See application file for complete search history.

(56) References Cited

U.S. PATENT DOCUMENTS 5,809,386 A * 9/1998 Iwata ..... 399/281
6,026,265 A * 2/2000 Kinoshita et al. ..... 399/281
6,149,564 A * 11/2000 Nozawa et al. ..... 492/30
6,196,958 B1 * 3/2001 Shiraki et al. ..... 492/59
2003/0210931 A1 * 11/2003 Haraguchi et al. ..... 399/281

FOREIGN PATENT DOCUMENTS

JP 07-160107 6/1995
JP 11-015246 1/1999
JP 2000194191 A * 7/2000

* cited by examiner

*Primary Examiner*—Hoang Ngo
(74) *Attorney, Agent, or Firm*—Rabin & Berdo, PC

(57) ABSTRACT

A developing apparatus supplies a developer from a developing roller to an image-bearing body that bears an electrostatic latent image thereon. A toner-supplying roller is rotatably supported to oppose the developing roller. A rotating body has recesses formed in its surface, opposing the developer-bearing member. The toner-supplying roller and the rotating body rotate in opposite directions and at different circumferential speeds. The rotating body is formed of a foamed material having cells formed in and open to a surface of the rotating body, the cells having a cell size in the range of 10 to 40 cells/inch. The toner-supplying roller and the rotating body rotate at circumferential speeds such that a ratio between the circumferential speeds is in the range of 1 to 2.5. The rotating body and toner-supplying roller may have a diameter that varies along the length.

10 Claims, 4 Drawing Sheets

DEVELOPING APPARATUS

FIELD OF THE INVENTION

The present invention generally relates to a developing apparatus for an electrophotographic image-forming apparatus.

DESCRIPTION OF RELATED ART

FIG. 7 illustrates a conventional image-forming apparatus.

A photoconductive drum 1 as an image bearing body is rotatably supported. When the photoconductive drum 1 rotates in a direction shown by arrow A, a charging roller 2 charges the outer circumferential surface of the photoconductive drum 1 uniformly. Then, an exposing unit in the form of, for example, an LED head or a laser scanning device irradiates the surface of the photoconductive drum 1 with light 3 in accordance with an image signal, thereby forming an electrostatic latent image on the photoconductive drum 1. In a developing unit 6, the electrostatic latent image is developed with toner into a toner image. The toner image is then transferred onto a recording medium 13 by a transfer roller. The recording medium 13 having the toner image thereon is then transported to a fixing unit 15 where the toner image is fused by heat under pressure on the recording medium 13 into a permanent image.

After transfer, a blade 14*a* of a cleaning unit 14 removes residual toner on the surface of the photoconductive drum 1 so that the photoconductive drum 1 is ready for the next image-forming cycle.

In order to develop the electrostatic latent image on the photoconductive drum 1, the developing unit 6 employs a one-component developing system that is relatively simple in construction. The developing unit 6 holds one-component toner therein. The toner is a non-magnetic pulverized toner or a polymer toner having an average diameter in the range of 7 to 9 μm.

A toner cartridge holds the toner therein and is attached to the developing unit 6. When the toner cartridge is opened, the toner falls from the toner cartridge into the developing unit 6. An agitating member 7 rotates to agitate the toner and delivers the toner to a toner-supplying roller 10 shown by arrow C. The developing roller 8 and toner-supplying roller 10 rotate in contact with each other, while maintaining a predetermined difference in circumferential speed therebetween. Thus, the developing roller 8 and toner-supplying roller 10 cooperate with each other to efficiently supply the toner to the circumferential surface of the developing roller 8 and remove the toner from the circumferential surface of the developing roller 8. The difference in circumferential speed between the developing roller 8 and the toner-supplying roller 10 creates friction, which in turn charges the toner to some degree. The difference in potential between the developing roller 8 and the toner-supplying roller 10 causes the toner to be deposited on the developing roller 8. As the developing roller 8 rotates, the toner on the developing roller 8 is delivered to a developing blade 9 that forms a thin layer of toner on the developing roller 8. As the developing roller 8 further rotates, the thin layer of toner is advanced to a developing region where the developing roller 8 rotates in contact with the photoconductive drum 1. The toner is attracted to the electrostatic latent image by the Coulomb force to form a toner image. Conventionally, developing units of one-component development type commonly employ a toner-supplying roller in the form of a foamed resilient roller of, for example, silicone rubber and urethane rubber.

Conventionally, a monochrome image-forming apparatus prints characters mainly and therefore only a small amount of toner per page requires to be deposited on the photoconductive drum. However, with increasing use of color images, solid images or substantially solid images are printed more often than before. Thus, it is required that a large, stable amount of toner is supplied uniformly for a long term. With prolonging lifetime and increasing printing speed of the apparatus, the toner-supplying roller is required to provide high performance. This results in the following problems. For example, the developing roller and toner-supplying roller rotate in the same direction. In other words, the developing roller and toner-supplying roller rotate in contact with each other and the contact areas run at different circumferential speeds in opposite directions.

A roller formed of silicone rubber is subjected to stress at the contact areas, so that walls between cells of a foamed body become plastically deformed and oriented in one direction as the accumulated number of rotations of the photoconductive drum 1 increases. As a result, the cells are clogged and the roller cannot hold a large amount of toner. When high-speed printing is performed to produce high-density images (solid images) in succession, a large amount of toner needs to be supplied constantly. After the accumulated number of rotations of the photoconductive drum 1 has reached a predetermined value, if a plurality of solid images are printed, the walls between cells on the part of the toner-supplying roller become plastically deformed in one direction, thereby closing the cells. Closed cells reduce toner supply, causing poor adhesion of toner to solid images, variations in density, and decreased image density.

SUMMARY OF THE INVENTION

An object of the invention is to provide a developing apparatus and an image forming apparatus which prevents poor adhesion of toner to solid images, density variations, and decreased image density and provides images having stable print quality.

A developing apparatus supplies a developer from a developer-bearing member to an image-bearing body that bears an electrostatic latent image thereon. The apparatus includes a developer-supplying member and a rotating body. The developer-supplying member is rotatably supported and opposes the developer-bearing member. The rotating body has recesses formed in its surface and opposing the developer-bearing member. The developing-roller and the rotating body rotate in opposite directions and at different circumferential speeds.

The rotating body is formed of a foamed material.

The foamed material is urethane and has cells open to a surface of the rotating body, the cells having a cell size in the range of 10 to 40 cells/inch.

The developer-supplying member and the rotating body are disposed either with a gap not more than 0.5 mm therebetween or with a nip not more than 1 mm therebetween.

The developer-supplying member and the rotating body rotate at circumferential speeds such that a ratio between the circumferential speeds is in the range of 1 to 2.5.

The rotating body rotates on a shaft having a first end and a second end, the rotating body being driven in rotation at the first end and having a diameter that is larger nearer the second end.

The developer-supplying member has a first diameter and a first length along which the first diameter is larger nearer a first middle portion of the developer-supplying member. The rotating body has a second diameter and a second length along which the second diameter is smaller nearer a second middle portion of the rotating body.

The rotating body is formed of an electrically semiconductive material. The rotating body receives a first voltage, and the developer-supplying member receives a second voltage. The first voltage has a larger absolute value than the second voltage.

A developing apparatus supplies a developer from a developer-bearing member to an image-bearing body that bears an electrostatic latent image thereon. The apparatus includes a developer-supplying member and a permanent deformation preventing member. The developer-supplying member rotatably supported and opposing the developer-bearing member. The permanent deformation preventing member opposes the developer-supplying member and prevents recesses formed in a surface of the developer-supplying member from remaining deformed permanently.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

FIRST EMBODIMENT

Figure 1:
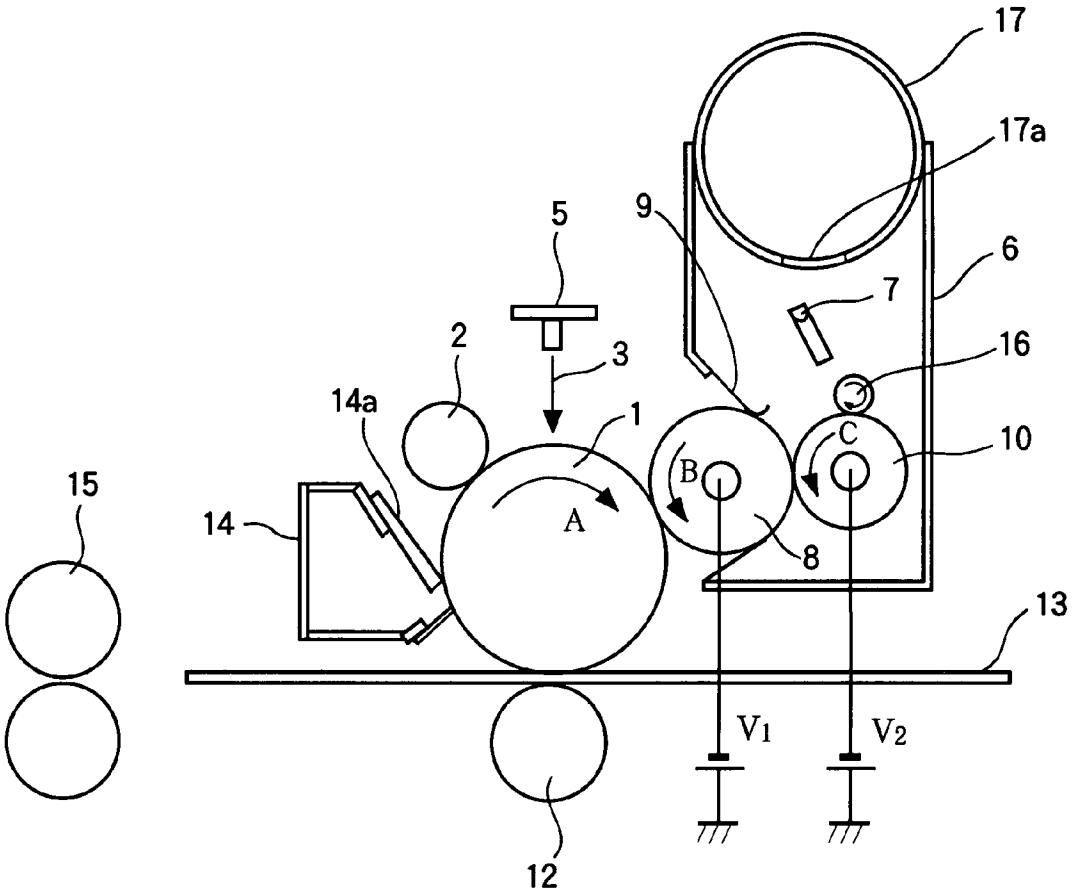
FIG. 1 illustrates the configuration of an image-forming apparatus to which a developing unit according to the present invention.

FIG. 1 illustrates the configuration of an image-forming apparatus to which a developing unit 6 according to the present invention is attached.

Referring to FIG. 1, the image-forming apparatus includes the developing unit 6, a photoconductive drum 1, a charging unit 2, and a cleaning unit 14, which are assembled integrally. The toner cartridge 17 is removably attached to the developing unit 6.

The charging roller 2 charges the surface of the photoconductive drum 1 to a potential of VH=−600V uniformly. An exposing unit 5 incorporates LEDs (light emitting diodes) that illuminate the charged surface of the photoconductive drum 1 in accordance with image information to form an electrostatic latent image having a potential of VL=−100 V on the photoconductive drum 1. The electrostatic latent image is developed in the developing unit 6 into a toner image. Then, as the photoconductive drum 1 rotates further, the toner image on the photoconductive drum 1 reaches a transfer roller 12, which in turn transfers the toner image onto a recording medium 13. The recording medium 13 is advanced to the fixing unit 15 where the toner image is fused by heat under pressure into a permanent image on the recording medium 13.

The respective components of the image-forming apparatus will be described. The process speed of the image-forming apparatus is 150 mm/sec at which an A4 size recording medium can be printed at a rate of 20 pages per minute.

The photoconductive drum 1 has an aluminum core having a diameter of 30 mm covered with a photoconductive layer, and rotates at a speed of 150 mm/sec.

The charging roller 2 is formed of epichlorohydrin rubber to which an ion conductor is added. The surface of the charging roller 2 is processed into an isocyanate. The charging roller 2 has an electrical resistance of $5\times10^5$ ohms and a diameter of 14 mm. The charging roller 2 is in contact with the photoconductive drum 1 and is driven in rotation. The shaft of the charging roller 2 receives a voltage of about −1150 V.

The shafts of the photoconductive drum 1 and the developing roller 8 are rotatably supported on frames, not shown, such that a nip is created between the photoconductive drum 1 and the developing roller 8. The developing roller 8 rotates at a circumferential speed as high as 1.3 times the photoconductive drum 1. The developing roller 8 and the photoconductive drum 1 rotate in opposite directions. The developing roller 8 is formed of urethane rubber into which carbon is disposed to act as an electrically conductive agent. The surface of the developing roller 8 is processed into an isocyanate. The developing roller 8 has an electrical resistance of $5\times10^5$ ohms, a diameter of 20 mm, and a surface roughness R2 of 4.5 μm. The shaft of the developing roller 8 receives a voltage V1 in the range of −170 to −260 V.

The developing blade 9 is formed of a stainless steel having a thickness of 0.2 mm and has a rounded edge that is polished into a mirror-like surface. The opposite side of the developing blade 9 from the rounded edge is fixed so that the round edge R is in contact with the developing roller 8 under a pressure of about 1 kg. The developing roller 8 and the developing blade 9 receive the same voltage. The shafts of the developing roller 8 and the toner-supplying roller 10 are rotatably supported on frames, not shown, such that a nip of about 1.1 mm is created between the developing roller 8 and the toner-supplying roller 10. The developing roller 8 and the toner-supplying roller 10 rotate in the same direction. The toner-supplying roller 10 rotates at a circumferential speed 0.7 times that of the developing roller 8. The toner-supplying roller 10 is formed of a foamed sponge of silicone rubber and has a hardness of 50 degrees (Asker F), an electrical resistance of $1\times10^6$ ohms, cells in the range of 0.2 to 1 mmϕ, and a diameter of 16 mm. The shaft of the toner-supplying roller 10 receives a voltage of V2 in the range of −300 to −400 V.

The toner is held in the toner cartridge 17, and discharged through an opening 17*a* into the developing unit 6. When the toner is exhausted, the toner cartridge 17 can be replaced. Replacing the toner cartridge 17 allows the developing unit 6 to be used for a long time.

The toner used in the present invention is a non-magnetic one-component toner. The toner is made of a pulverized polyester with an average particle diameter of 8 μm. In order to adjust the fluidity and charge-resistance of the toner, silica of different sizes are added to the toner.

The developing unit 6 of the image-forming apparatus according to the first embodiment will be described. The cartridge 17 holds the toner and is attached to a container. When the opening 17*a* of the toner cartridge 17 is opened, the toner falls from the toner cartridge 17. An agitating member 7 in the toner cartridge 17 agitates the toner and delivers the toner to the toner-supplying roller 10 that rotates in a direction shown by arrow C. The developing roller 8 can rotate in a direction shown by arrow B. The developing roller 8 and the toner-supplying roller 10 rotate in the same direction while also being in contact with each other. This enables efficient supply of toner to the surface of developing roller 8 and efficient removal of toner from the surface of the developing roller 8. The difference in circumferential speed between the developing roller 8 and the toner-supplying roller 10 creates friction between these two rollers so that the toner is charged to a certain level due to the friction. As the developing roller 8 rotates, the toner is delivered to the developing blade 9, which in turn forms a thin layer of toner on the developing roller 8. Then, the thin layer of toner is advanced to the developing region as the developing roller 8 rotates.

The photoconductive drum 1 and the developing roller 8 have areas in contact with each other, the areas moving in opposite directions to each other. The toner is attracted to the electrostatic latent image formed on the photoconductive drum 1 by the Coulomb force, thereby forming a toner image.

Figure 3A:
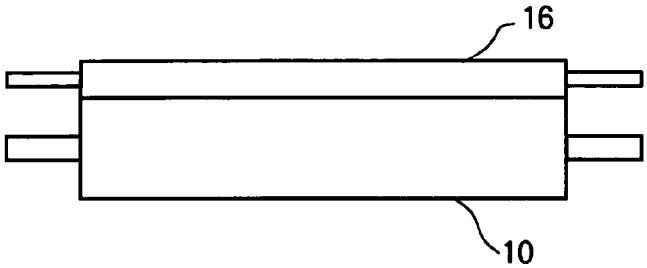
FIG. 3A illustrates the rotating body and the toner-supplying roller when they abut each other with a nip formed between them.

FIG. 3A illustrates a rotating body 16 and the toner-supplying roller 10 when they abut each other with a nip N formed between them.

Figure 3B:
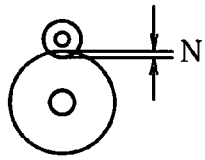
FIG. 3B is a side view of FIG. 3A.

FIG. 3B is a side view of FIG. 3A.

Figure 4A:
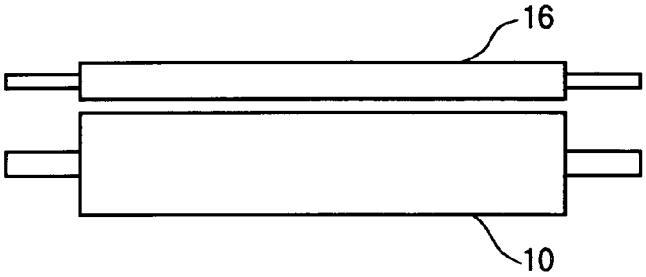
FIG. 4A illustrates the rotating body and the toner-supplying roller when a gap exists between them.

FIG. 4A illustrates the rotating body 16 and the toner-supplying roller 10 when a gap G exists between them.

Figure 4B:
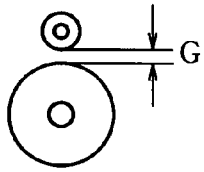
FIG. 4B is a side view of FIG. 4A.

FIG. 4B is a side view of FIG. 4A;

Referring to FIG. 4A, the rotating body 16 rotates in a direction opposite to the toner-supplying roller 10 at a speed 1.6 times that of the toner-supplying roller 10.

The rotating body 16 according to the present invention has a shaft covered with a cellular synthetic material, e.g., a foamed sponge. The rotating body 16 has recesses on the surface. The foamed sponge may be formed of, for example, a synthetic rubber, urethane sponge, or silicone sponge but is not limited to these and may be formed of any suitable material. By way of example, urethane sponge is used in the present invention. The rotating body 16 has 20 cells/inch, a hardness of 80 degrees F. (Asker F), and a diameter of 10 mm. The rotating body 16 may not have cells.

The toner-supplying roller 10 has an area in contact with the developing roller 8. Upstream of the area with respect to the direction of rotation of the toner-supplying roller 10, the rotating body 16 and the toner-supplying roller 10 abut each other with a nip of about 0.3 mm.

It is now assumed that the rotating body 16 is absent. The toner-supplying roller 10 abuts the developing roller 8 and rotates in an opposite direction to the developing roller 8. The cells formed in the sponge surface of the toner-supplying roller 10 create recesses on the sponge surface. The toner-supplying roller 10 is constantly rubbed in the same direction by the developing roller 8. After the first half of the lifetime of the apparatus, cell walls 10*a* formed in the sponge surface of the toner-supplying roller 10 incline to close the cells, thereby decreasing the ability to deliver toner and resulting in a decreased toner supply to the developing roller 8. As a result, when solid images are printed in succession, a sufficient amount of toner cannot be supplied, resulting in white areas that appear in the printed images. In this specification, the term "poor toner deposition" refers to this phenomenon. The phenomenon becomes prominent, for example, when toner loses fluidity due to repetitive printing with low print duty, and when the cell walls 10*a* of the sponge surface deteriorate.

The following are factors that cause the cell walls 10*a* of the sponge of the toner-supplying roller 10 to deteriorate.

(1) Printing speed of the image-forming apparatus is high.

(2) The developing unit is operated for a long term.

(3) The toner-supplying roller 10 abutting the developing roller 8 is apt to wear.

(4) Air contains a large amount of moisture in a high-temperature and high-humidity environment and the large amount of moisture increases the friction between the toner-supplying roller 10 and the developing roller 8.

A toner cartridge for a developing unit incorporated in a high-speed image-forming apparatus is replaced from time to time, so that the developing unit is operated for a long term. However, in a high-temperature and high-humidity environment, printing solid images on many pages after having performed low-duty printing (e.g., almost white paper) causes prominent deterioration of the cell walls 10*a* of the toner-supplying roller 10.

Figure 2A:
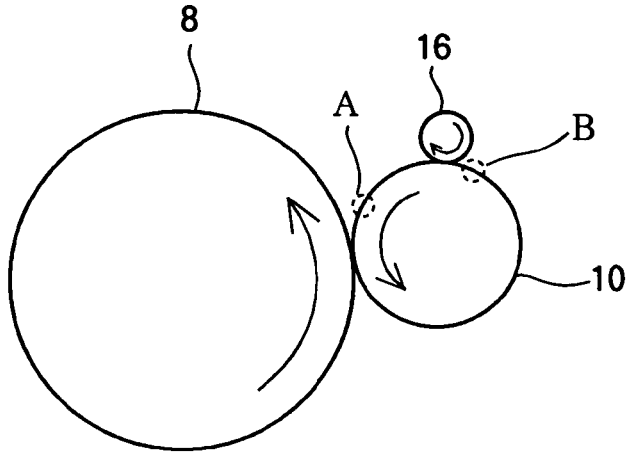
FIG. 2A illustrates a toner-supplying roller, a developing roller, and a rotating body.

In order to solve this problem, the rotating body 16 is employed in the present invention. The rotating body 16 operates as follows:

FIG. 2A illustrates the toner-supplying roller 10, developing roller 8, and rotating body 16.

Figure 2B:
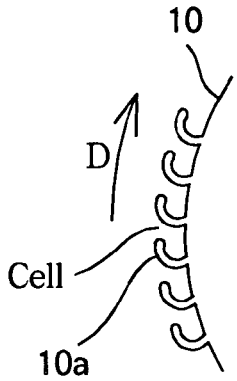
FIG. 2B is an enlarged view of a portion A of FIG. 2A.

FIG. 2B is an enlarged view of a portion A of FIG. 2A.

Figure 2C:
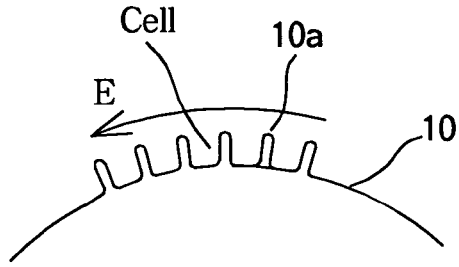
FIG. 2C is an enlarged view of a portion B of FIG. 2A.

FIG. 2C is an enlarged view of a portion B of FIG. 2A.

Figure 2D:
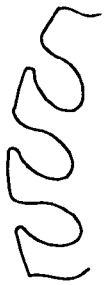
FIG. 2D illustrates a modification to the shape of cells in FIG. 2B.

FIG. 2D illustrates a modification to the shape of cells in FIG. 2B.

Figure 2E:
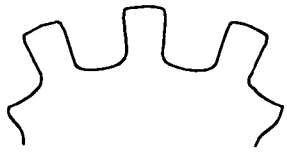
FIG. 2E illustrates the shape of cells when a force acts in a direction shown by arrow E.

FIG. 2E illustrates the shape of cells when the cell walls 10*a* regain their original shape by the force acting in a direction shown by arrow E.

Assume that the rotating body 16 is not incorporated in the developing unit 6. Because the toner-supplying roller 10 is constantly rubbed by the developing roller 8 in a direction shown in FIG. 2B, the cell walls 10*a* tend to incline after the first half of the lifetime of the toner-supplying roller 10. The rotating body 16 rotates in the opposite direction to the toner-supplying roller 10 at a higher speed than the toner-supplying roller 10. Thus, as shown in FIG. 2A, if the rotating body 16 is in an abutting relation with the toner-supplying roller 10, a force acts on the cell walls 10*a* in a direction opposite to that in FIG. 2B. This force acts in a direction opposite to a force exerted on the toner-supplying roller 10 by the developing roller 8. Thus, the cell walls 10*a* receives a force in a direction shown by arrow D in FIG. 2C alternately with a force in the direction shown by arrow E in FIG. 2C, so that the cell walls 10*a* do not remain permanently inclined in one direction. This prevents the cell walls 10*a* from closing the cells. The rotating body 16 rotates at a higher speed than the toner-supplying roller 10, thereby supplying the toner to the toner-supplying roller 10. In this manner, even when there is a potential for poor toner deposition, poor toner deposition will not occur throughout the lifetime of the image-forming apparatus.

Referring to FIG. 4B, if there is a small gap between the rotating body 16 and the toner-supplying roller 10, the rotation of the rotating body creates a force that acts on the toner-supplying roller 10. This force is similar in effect to the force that the rotating body 16 exerts on the toner-supplying roller 10 when the rotating body 16 is in an abutting relation with the toner-supplying roller 10. Such a force, even though small, is effective in preventing the cell walls 10 from closing the cells. Likewise, the rotating body 16 rotates at a higher speed than the toner-supplying roller 10, thereby supplying a sufficient amount of toner to the toner-supplying roller 10 when solid images are printed in succession.

In the present embodiment, the voltage V2 supplied to the toner-supplying roller 10 and the voltage V3 supplied to the rotating body 16 are related such that $|V2|<|V3|$. The potential difference between V2 and V3 creates a Coulomb force that causes the charged toner to migrate toward the toner-supplying roller 10. This allows supplying of a sufficient amount of toner to the toner-supplying roller 10. The rotating body 16 takes the form of a foamed electrically semi-conductive body that contains an electrically conductive agent.

The advantages of the aforementioned configuration will be described in detail by conducting specific tests.

When the test was conducted without using the rotating body 16 according to the invention, print duty was selected by assuming that a normal photograph is printed. That is, printing was performed in two modes: a mode of a print duty of 20% in which a relatively large amount of toner is consumed and a mode of a print duty of about 5% in which a relatively small amount of toner is consumed. In order to detect insufficient toner deposition, 5 solid images are printed on 5 consecutive pages after 1000th page. The tests were made for a normal environment (20° C., 50% RH) and a high-temperature and high-humidity environment (27° C., 80% RH).

When the test was conducted with the rotating body 16 according to the invention incorporated in the apparatus, printing was performed at a print duty of 5% in an environment of 27° C. and 80% RH.

Solid images were printed on five consecutive pages. Table 1 lists the test results. Test results were classified as follows: Symbol "○" indicates that no poor toner deposition was detected. Symbol "Δ" indicates that print results were normal for up to the 3rd page but poor toner deposition was detected for the 4th and 5th pages. Symbol "X" indicates that poor toner deposition was detected in any one page from the 1st to 3rd pages.

TABLE 1

| ROTATING BODY | NOT USED | NOT USED | NOT USED | USED |
|---|---|---|---|---|
| PRINT DUTY | >20% | 5% | 5% | 5% |
| ENVIRONMENT | 20° C., 50% | 20° C., 50% | 27° C., 80% | 27° C., 80% |
| INITIAL | ○ | ○ | ○ | ○ |
| 10K PAGES | ○ | ○ | Δ | ○ |
| 20K PAGES | ○ | Δ | X | ○ |
| 30K PAGES | ○ | X | X | ○ |

Even if the rotating body 16 is not incorporated, no poor toner deposition was detected until the apparatus reaches the end of its lifetime provided that printing is performed at a high print duty (e.g., 20%) in a normal environment. However, if a printed page has a large non-printed area just as in printing of characters of about print duty of 5%, poor toner deposition occurs after the first half of the lifetime of the apparatus. In a high-temperature and high-humidity environment, poor toner deposition occurs after one-third of the lifetime of the apparatus. The apparatus that incorporates the rotating body 16 according to the invention was free from poor toner deposition until the end of the lifetime of the apparatus even when a character pattern of a print duty of 5% was tested. Also, when the rotating body 16 is incorporated in the apparatus, no poor toner deposition occurred for a print duty of 5% and a print duty of 20% in the normal environment.

In the first embodiment, the rotating body 16 in the form of a sponge roller may be disposed to abut the toner-supplying roller 10 or spaced apart with a small gap between the rotating body 16 and the toner-supplying roller 10. The rotating body 16 and the toner-supplying roller 10 rotate in opposite directions but the rotating body 16 rotates at a higher speed than the toner-supplying roller 10. This configuration offers print quality free from poor toner deposition throughout the lifetime of the apparatus in a high-temperature and high-humidity environment regardless of print duty, irrespective of print patterns having a low print duty or solid images having a high print duty. Experiment was conducted for two cases: a case where the rotating body 16 abuts the toner-supplying roller 10 and a case where the rotating body 16 and the toner-supplying roller 10 are spaced by a small gap. Substantially the same results were obtained for both cases.

SECOND EMBODIMENT

A good material for the rotating body 16 is urethane sponge. A second embodiment will be described with respect to the preferred ranges of (1) the size of cells formed in the urethane sponge, (2) the size of gap and nip between the rotating body 16 and the toner-supplying roller 10, and (3) the ratio of the circumferential speed of the toner-supplying roller 10 to that of the rotating body 16.

The configuration of the second embodiment is the same as the first embodiment. Tests were conducted for a total of five rotating bodies having cells of different sizes: 5, 10, 20, 40, and 50 cells/inch. The size of the nip between the rotating body 16 and the toner-supplying roller 10 was 0.3 mm. The ratio of the circumferential speed of the rotating body 16 to that of the toner-supplying roller 10 was 1.6. Printing was performed at a print duty of 5% in a high-temperature and high-humidity environment. Tests were conducted in a similar way to the first embodiment. Table 2 lists the test results.

TABLE 2

| | Environment: 27° C., 80% Print duty: 5% | | | | |
|---|---|---|---|---|---|
| | NUMBER OF CELLS | | | | |
| NUMBER OF PAGES | 5 | 10 | 20 | 40 | 50 |
| INITIAL | ○ | ○ | ○ | ○ | ○ |
| 10K PAGES | Δ | ○ | ○ | ○ | ○ |
| 20K PAGES | X | ○ | ○ | ○ | Δ |
| 30K PAGES | X | ○ | ○ | ○ | X |

Table 2 reveals that cell sizes in the range of 10 to 40 cells/inch yield good print results. The print result was no good for a cell size of 5 cells/inch. This is considered to be due to the fact that cells are too large. Print result was no good for a cell size of 50 cells/inch. This is considered to be due to the fact that cells are too small.

In order to determine the ranges of gap and nip between the rotating body 16 and the toner-supplying roller 10, tests were conducted by decreasing the gap in decrements of 0.5 mm from 1 mm until the gap is zero and then increasing the nip stepwise. The gaps were 1.0 mm, 0.5 mm, and 0 mm. The nips were 0.5 mm, 1 mm, and 1.5 mm. The cell size of the rotating body 16 was 20 cells/inch, and the ratio of the circumferential speed of the rotating body 16 to that of the toner-supplying roller 10 was 1.6. Printing was performed at a print duty of 5% in a high-temperature and high-humidity environment. Table 3 lists the test results.

TABLE 3

| | Environment: 27° C., 80% Print duty: 5% | | | | | |
|---|---|---|---|---|---|---|
| NUMBER OF | GAP (mm) | | | NIP (mm) | | |
| PAGES | 1.0 | 0.5 | 0 | 0.5 | 1.0 | 1.5 |
| INITIAL | ○ | ○ | ○ | ○ | ○ | ○ |
| 10K PAGES | ○ | ○ | ○ | ○ | ○ | ○ |
| 20K PAGES | Δ | ○ | ○ | ○ | ○ | ○ |
| 30K PAGES | X | ○ | ○ | ○ | ○ | ○ |

The tests reveal that a gap not more than 0.5 mm provides good print results. A gap more than 0.5 mm did not produce enough force transmitted to the toner-supplying roller 10, and was therefore not effective. Nips not more than 1 mm did not cause poor toner deposition. Nips more than 1 mm did not cause poor toner deposition but increased the friction between the rotating body 16 and the toner-supplying roller 10, and jitters appeared on the printed images.

Then, in order to determine the range of the ratio of the circumferential speed of the rotating body 16 to that of the toner-supplying roller 10, the tests were conducted for the speed ratios of 0.8, 1.1, 1.5, 2, and 2.5. In the tests, the cell size of the rotating body 16 was selected to be 20 cells/inch and the nip was selected to be 0.3 mm. The tests were conducted at a print duty of 5% in a high-temperature and high-humidity environment just as in the first embodiment. Table 4 lists the test results.

TABLE 4

| | Environment: 27° C., 80% Print duty: 5% | | | | |
|---|---|---|---|---|---|
| | SPEED RATIO | | | | |
| | 0.8 | 1.1 | 1.5 | 2 | 2.5 |
| INITIAL | ○ | ○ | ○ | ○ | ○ |
| 10K PAGES | ○ | ○ | ○ | ○ | ○ |
| 20K PAGES | Δ | ○ | ○ | ○ | ○ |
| 30K PAGES | X | ○ | ○ | ○ | ○ |

Tests reveal that a preferred range of the speed ratio is from 1.1 to 2.0. This is due to the fact that speed ratios not more than 1 is not effective in raising the cell walls 10*a* and the amount of toner delivered is small accordingly. No poor toner deposition occurred when the speed ratio exceeded 2 but the load due to the friction became large, increasing jitters and therefore deteriorating image quality. Thus, a preferred range of the speed ratio is from 1.1 to 2.0.

THIRD EMBODIMENT

A3 size paper has a greater lateral dimension than A4 size paper. The toner-supplying roller 10 and the developing roller 8 are pressed against each other to form a nip between them. The pressing force acting on the two rollers causes the shafts of the two rollers to flex, with the result that the pressing force is larger at the longitudinal ends of the two rollers than at the middle of the two rollers. Consequently, the ability of the toner-supplying roller 10 to remove the toner from the middle portion of the developing roller 8 decreases. This causes the toner on the developing roller 8 to be charged more and therefore the layer of toner increases in thickness, resulting in variations in image density.

Figure 5A:
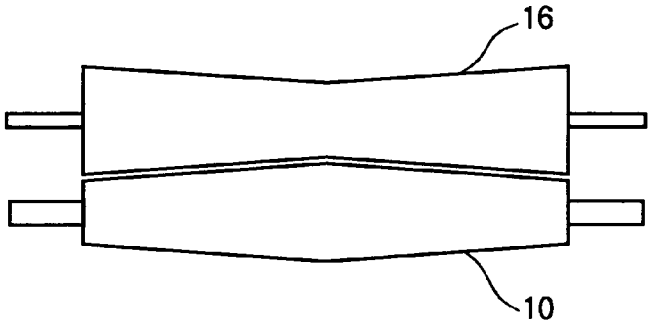
FIG. 5A illustrates an example of the toner-supplying roller and the rotating body according to a fourth embodiment.

FIG. 5A illustrates an example of the toner-supplying roller 10 and the rotating body 16 according to a fourth embodiment.

Figure 5B:
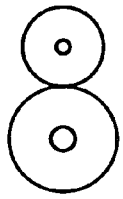
FIG. 5B is a side view of FIG. 5A.

FIG. 5B is a side view of FIG. 5A.

In order to solve the aforementioned drawbacks, the sponge of the toner-supplying roller 10 has an outer shape in the form of a combination of truncated circular cones with their large-diameter surfaces in contact with each other as shown in FIG. 5A. FIG. 5A is somewhat exaggerated for the purpose of illustration. The toner-supplying roller 10 extends in a longitudinal direction and has a diameter that increases toward the middle portion of the toner-supplying roller 10. This change in diameter exerts a substantially uniform pressing force across the length of the toner-supplying roller 10, thereby providing images with uniform density. When the rotating body 6 is used with the toner-supplying roller 10 in the shape of combined truncated cones, the gap and nip between the two rollers vary along their lengths. In order to solve this problem, the rotating body 16 is made in the shape of combined truncated cones having small diameter surfaces in contact with each other. In other words, the rotating body 16 extends in a longitudinal direction and has a diameter that decreases toward the middle of the rotating body 16. The circumferential speed varies continuously along the length of the toner-supplying roller 10. The average of the differences in circumferential speed between the toner-supplying roller 10 and the rotating body 16 is not more than 20%. The ratio of the circumferential speed varies from 1 to 2.5 and the average is 1.6.

The following were prepared:

(1) the toner-supplying roller 10 in the shape of combined truncated cones with large-diameter surfaces in contact with each other, (3) the rotating body 16 in the shape of a cylinder, and (4) the rotating body 16 in the shape of combined truncated cones with small-diameter surfaces in contact with each other.

Then, tests were conducted with the same conditions as the first embodiment.

TABLE 5

| Environment: 27° C., 80% Print duty: 5% | | |
|---|---|---|
| NUMBER OF PAGES CONES | CYLINDER | COMBINED |
| INITIAL | ○ | ○ |
| 10K PAGES | ○ | ○ |

TABLE 5-continued

| Environment: 27° C., 80% Print duty: 5% | | |
|---|---|---|
| NUMBER OF PAGES CONES | CYLINDER | COMBINED |
| 20K PAGES | ○ | ○ |
| 30K PAGES | Δ | ○ |

When the rotating body 16 is cylindrical, poor toner deposition occurred toward the end of the lifetime of the rotating body 16. However, the combination of truncated cones eliminated the chance of poor toner deposition of occurring, and resulted in good test results.

FOURTH EMBODIMENT

A fourth embodiment is to solve a drawback similar to that addressed in the third embodiment, and discloses another example of the shape of a rotating body and a toner-supplying roller. The fourth embodiment features a tapered rotating body 16 and a tapered toner-supplying roller 10.

The rotating body 16 has a gear secured to its shaft and receives a drive power from the toner-supplying roller 10 through a gear train. In this case, the pressing forces acting on longitudinal ends of the toner-supplying roller 10 are different from that acting at the other longitudinal end of the toner-supplying roller 10. Thus, poor toner deposition tends to occur at the ends of the shaft driven by the gear.

Figure 6A:
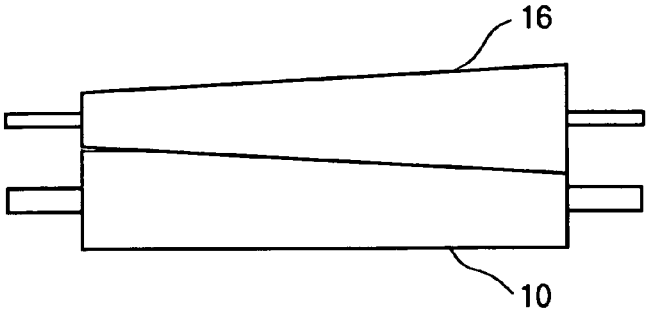
FIG. 6A illustrates an example of a tapered toner-supplying roller and a tapered rotating body according to the fourth embodiment.

FIG. 6A illustrates an example of the tapered toner-supplying roller 10 and the tapered rotating body 16 according to the fourth embodiment.

Figure 6B:
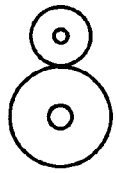
FIG. 6B is a side view of FIG. 6A.
Figure 7:
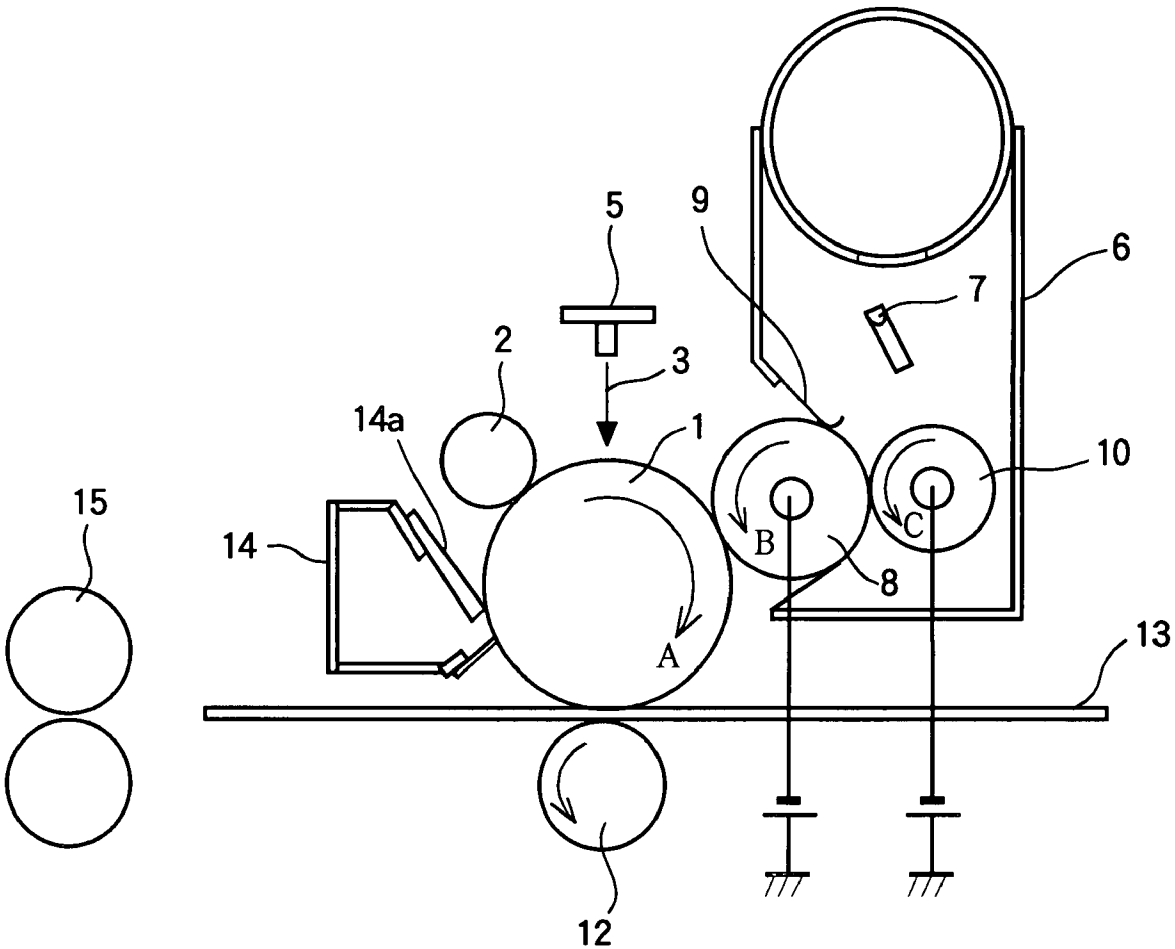
FIG. 7 illustrates a conventional image-forming apparatus.

FIG. 6B is a side view of FIG. 6A.

The shaft of the rotating body 16 has a first end and a second end and is driven in rotation at the first end. The rotating body 16 and the toner-supplying roller 10 are tapered such that the diameter increases linearly from one longitudinal end to the other longitudinal end.

The cylindrical rotating body 16 and the tapered rotating body 16 were manufactured and tested just as in the first embodiment. Table 6 lists the test results.

TABLE 6

| Environment: 27° C., 80% Print duty: 5% | | | | |
|---|---|---|---|---|
| | SHAPE | | | |
| | CYLINDER | | TAPERED | |
| LEFT/RIGHT | LEFT | RIGHT | LEFT | RIGHT |
| INITIAL | ○ | ○ | ○ | ○ |
| 10K PAGES | ○ | ○ | ○ | ○ |
| 20K PAGES | ○ | ○ | ○ | ○ |
| 30K PAGES | ○ | Δ | ○ | ○ |

Toward the end of the lifetime of the apparatus, poor toner deposition occurred on the longitudinal end portion of the cylindrical rotating body 16 driven by the gear. Test results were good on the other longitudinal end portion driven by the gear. The tapered rotating body 16 did not cause poor toner deposition throughout the lifetime of the apparatus.

Although the first to fourth embodiments have been described with respect to an image-forming apparatus having a single image-forming section, the present invention may be applied to a tandem type color printer in which four color image-forming sections are cascaded.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus that supplies a developer from a developer-bearing member to an image-bearing body that bears an electrostatic latent image thereon, the apparatus comprising:

a developer-bearing body rotatably supported and opposing said electrostatic latent image bearing body, said developer bearing body supplying developer to said electrostatic latent image bearing body;

a developer-supplying member rotatably supported and opposing the developer-bearing member, said developer-supplying member being formed of a foamed material and supplying the developer to said developer bearing body; and a rotating body having cell walls formed on its surface and opposing said developer-supplying member;

wherein said rotating body rotates in an opposite direction to said developer-bearing body at a higher circumferential speed than said developer-supplying member, and has a higher hardness than said developer-supplying member.

2. The developing apparatus according to claim 1, wherein said rotating body is formed of a foamed material.

3. The developing apparatus according to claim 2, wherein the foamed material is urethane and the cell walls form cells open to a surface of said rotating body, the cells having a cell size in the range of 10 to 40 cells/inch.

4. The developing apparatus according to claim 1, wherein said developer-supplying member and said rotating body rotate at circumferential speed such that a ratio between the circumferential speeds is in the range of 1 to 2.5.

5. The developing apparatus according to claim 1, wherein said rotating body rotates on a shaft having a first end and a second end, said rotating body being driven in rotation at the first end and having a diameter that is larger nearer the second end.

6. The developing apparatus according to claim 1, wherein said developer-supplying member has a first diameter and a first length along which the first diameter is larger nearer a first middle portion of said developer-supplying member;

wherein said rotating body has a second diameter and a second length along which the second diameter is smaller nearer a second middle portion of said rotating body.

7. The developing apparatus according to claim 3, wherein said rotating body is formed of an electrically semiconductive material;

wherein said rotating body receives a first voltage, and said developer-supplying member receives a second voltage, the first voltage having a larger absolute value than the second voltage.

8. The developing apparatus according to claim 1, wherein said rotating body is spaced from said developer bearing body.

9. The developing apparatus according to claim 2, wherein said developer-supplying member and said rotating body are disposed with a gap not more than 0.5 mm therebetween.

10. The developing apparatus according to claim 2, wherein said developer-supplying member and said rotating body are disposed with a nip not more than 1 mm therebetween.

* * * * *